US006829329B1

(12) United States Patent
Warburton

(10) Patent No.: US 6,829,329 B1
(45) Date of Patent: Dec. 7, 2004

(54) TARGET FOR A STATIONARY ANODE IN AN X-RAY TUBE

(75) Inventor: Don Warburton, West Jordan, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/052,166

(22) Filed: Jan. 17, 2002

(51) Int. Cl.[7] ..... H01I 35/06
(52) U.S. Cl. ..... 378/143; 378/121; 378/119
(58) Field of Search ..... 378/121, 143, 378/144, 119

(56) References Cited

U.S. PATENT DOCUMENTS 5,768,338 A * 6/1998 Kuroda et al. ..... 378/143
6,289,079 B1 * 9/2001 Chornenky et al. ..... 378/143
6,393,099 B1 * 5/2002 Miller ..... 378/143

* cited by examiner

*Primary Examiner*—Edward J. Glick
*Assistant Examiner*—Hoon Song
(74) *Attorney, Agent, or Firm*—Workman Nydegger

(57) ABSTRACT

A target cap for preventing the production of contaminating secondary x-rays from a stationary anode x-ray tube is disclosed. The x-ray tube includes an evacuated enclosure in which is disposed a cathode and an anode. The target cap is useful in applications such as x-ray fluorescence spectroscopy for improving the spectral purity of the stream of primary x-rays produced by electron bombardment of the anode target surface by the cathode. In one embodiment, the target cap comprises a top target surface and a side wall covering a portion of the anode substrate. Electrons backscattered from the target surface are attracted to the anode substrate and impact the side wall of the target cap, producing secondary x-rays having characteristic wavelengths that are substantially identical to those of the primary x-rays produced by the target surface and are therefore not contaminating to the primary x-ray stream.

21 Claims, 3 Drawing Sheets

TARGET FOR A STATIONARY ANODE IN AN X-RAY TUBE

BACKGROUND OF THE INVENTION

1. The Field of the Invention

The present invention generally relates to x-ray generating devices. More particularly, the present invention relates to embodiments of an x-ray tube anode target that substantially reduces the production of off-focus x-rays.

2. The Related Technology

X-ray generating devices are extremely valuable tools that are used in a wide variety of applications, both industrial and medical. Such equipment is commonly used in applications such as diagnostic and therapeutic radiology, semiconductor fabrication, joint analysis, and non-destructive materials testing. While used in a number of different applications, the basic operation of an x-ray tube is similar. In general, x-rays are produced when electrons are accelerated and impinged upon a material of a particular composition.

X-ray generating devices typically include an electron source, or cathode, and an anode disposed within an evacuated enclosure. The anode includes a target surface that is oriented to receive electrons emitted by the cathode. In operation, an electric current is applied to a filament portion of the cathode, which causes electrons to be emitted by thermionic emission. The electrons are then accelerated toward the target surface of the anode by applying a high voltage potential between the cathode and the anode. Upon striking the anode target surface, some of the resulting kinetic energy is released as electromagnetic radiation of very high frequency, i.e., x-rays.

The x-rays produced by the x-ray tube target surface are known as primary x-rays and cover a range, or spectrum, of x-ray wavelengths. Though a given x-ray tube normally produces some primary x-rays along the entire x-ray wavelength spectrum, it also produces a high number, or peak, of x-rays at one or more distinct wavelengths along the spectrum. The wavelength(s) where these x-rays peaks are produced are uniquely characteristic of the material comprising the target surface of the x-ray tube anode, and thus are known as characteristic x-rays. Anode target surface materials with high atomic numbers ("Z" numbers) are typically employed because they produce ample numbers of characteristic x-rays. The characteristic and other primary x-rays, once produced, ultimately exit the x-ray tube through a window disposed in the evacuated enclosure, and interact in or on various material samples or patients. As is well known, the x-rays can be used for sample analysis procedures, therapeutic treatment, or in medical diagnostic applications.

One application for which x-ray tubes are well suited is referred to as x-ray fluorescence spectroscopy ("XRF"). XRF is typically used to determine the elemental composition of a selected material. An XRF instrument setup typically includes an analytical x-ray tube (AXT), a specimen to be analyzed, a collimator, a diffracting crystal, and an x-ray detector. To analyze the composition of the specimen, the x-ray tube is activated and x-rays are directed at the specimen. The interaction of the x-rays, particularly the characteristic x-rays, with the atoms in the specimen causes the atoms to emit, or fluoresce, a second group of excited x-rays, some of which possess wavelengths characteristic of the elements in the specimen. Once emitted by the sample, the fluoresced x-rays are dispersed into an x-ray spectrum by a diffracting crystal, then collimated towards a detector and associated instrumentation, which quantify and correlate the results. Similar to the characteristic x-ray peaks produced by the x-ray tube target material, the intensities of the various wavelength peaks in the XRF spectrum are roughly proportional to the concentration of the corresponding elements that comprise the specimen. In this way, the elemental composition of a variety of materials may be ascertained.

Many x-ray tubes employ a rotary anode that rotates portions of its target surface into and out of the stream of electrons produced by the cathode. However, analytical x-ray tubes, such as those used for XRF applications, typically use a stationary anode. The stationary anode typically includes a substrate portion, comprised of copper or similar material, and the target surface, which may comprise rhodium, palladium, tungsten, or any other suitable material. For an XRF procedure to yield superior results when assaying a specimen, it is highly desirable that the x-ray tube produce a stream of primary x-rays that is spectrally pure, i.e., the x-ray wavelength spectrum of the primary x-ray stream contains characteristic wavelength peaks that originate only from the target material disposed on the target surface of the x-ray tube anode, and not from contaminating x-ray sources.

Unfortunately, many of the electrons that impact the target surface do not produce primary x-rays. Rather, a significant number of electrons simply rebound from the anode target surface and strike other non-target surfaces within the x-ray tube, such as the anode substrate. These electrons are often referred to as "back-scattered" electrons. These back-scattered electrons retain a significant amount of their original kinetic energy after rebounding. As such, these secondary collisions with non-target surfaces can produce secondary x-rays having wavelengths that are characteristic of the material impinged, such as copper. These secondary x-rays are emitted from the x-ray tube along with the primary x-rays created at the target surface of the stationary anode. In XRF spectroscopy, these secondary x-rays may be considered an undesirable contamination of the primary x-ray stream because they can interfere with the measurement of the fluorescing x-rays emanating from the specimen under analysis. In other words, an XRF detector may mistake a contaminating secondary x-ray having, for example, a characteristic copper wavelength produced by the copper anode substrate as having been produced by a fluorescing copper atom present in the specimen under analysis. Thus, to optimize the spectral purity of the signal, it is critical to reduce or eliminate contaminating secondary x-rays from the x-ray emissions of an x-ray tube.

Several attempts have been made to eliminate secondary x-ray contamination from primary x-ray emissions. One approach has involved the use of a graphite layer to cover a portion of the anode substrate where back-scattered electrons typically impact. Though this approach reduces the amount of contaminating x-rays that are emitted, it gives rise to other problems. In particular, the approach results in serious outgassing and particle creation problems during tube operation because of differing thermal expansion rates between the graphite layer and the anode substrate, and because of the extensive machining and handling steps required for assembly and attachment of the graphite layer. Outgassing and particle creation within the evacuated environment of an x-ray tube are highly detrimental to its performance and operating lifetime. Additionally, a graphite layer is relatively difficult to attach to the surface of a stationary anode.

Another approach has involved extending the target surface beyond the periphery of the anode substrate to create an overhanging ledge that serves as a barrier to electrons backscattered off of the target surface. While partially effective in blocking some backscattered electrons, the ledge may be unable to stop electrons that travel beyond the ledge and impact the anode substrate, creating contaminating secondary electrons. Moreover, a target surface having an overhanging ledge of this type may not conduct heat as efficiently as desired.

In light of the above, therefore, a need exists for a stationary x-ray tube that reduces or eliminates the production of contaminating secondary x-rays. This need is especially acute in x-ray tubes employed in XRF spectroscopy operations, which require spectrally pure x-ray streams. Further, any solution to enable the creation of spectrally pure x-ray streams should do so without creating ensuing problems, such as outgassing, particle creation, or heat conduction problems that are detrimental to the operation of the tube.

BRIEF SUMMARY OF THE INVENTION

The present invention has been developed in response to the current state of the art, and in particular, in response to these and other problems and needs that have not been fully or adequately solved by currently available x-ray tubes. Briefly summarized, embodiments of the present invention are directed to an anode target cap that reduces or eliminates contaminating secondary x-ray emission in stationary anode x-ray tubes. In addition, the anode target is implemented in a manner so as to prevent other problems within the tube, such as outgassing, particle creation, and thermal retention.

The anode target cap as disclosed in preferred embodiments generally comprises a body having a planar top wall and a continuous, cylindrical side wall. The top and side walls cooperate to define a cylindrical cavity into which is received one end of the anode substrate such that the end and a portion of the substrate adjacent the end is covered.

The target cap is comprised of a material that is capable of producing x-rays, such as rhodium, palladium, or tungsten. This enables the outer surface of target cap top wall to serve as the target surface of the stationary anode. As such, the top wall of the cap is oriented to receive electrons from the cathode that strike the target surface and produce a stream of primary x-rays.

The side wall of the target cap comprises a length sufficient to cover the portion of the anode substrate that is susceptible to impingement by backscattered electrons. In this way, backscattered electrons that otherwise would impact the anode substrate instead impinge the side wall of the target cap. Because the side wall of the target cap comprises the same material as the target surface, the wavelengths of the secondary characteristic x-rays that are produced by the impingement of the backscattered electrons on the side wall are nearly identical to the wavelengths of the primary characteristic x-rays produced by the target surface. As a result, any side wall-produced secondary x-rays that exit the tube along with the primary x-ray stream do not negatively impact or interfere with the analysis being conducted with the x-ray tube. This, in turn, results in improved performance of x-ray tube, as well as more reliable analysis results, especially in applications such as XRF.

The thickness of the top and side walls of the target cap may be varied according to the particular application, but it need only be thick enough to prevent the penetration of backscattered electrons through the top or side walls. The longitudinal length of the side wall may be varied to cover as much or as little of the surface of the anode substrate as may be needed for a particular tube application. The desired side wall length is determined by several factors, including the amount of energy imparted to the electrons during their acceleration from the filament to the target surface on the target cap.

The present anode target cap makes possible the production of spectrally pure primary x-ray streams by reducing or eliminating the production of contaminating secondary x-rays. Inaccuracies created by such contamination in sensitive analysis procedures, such as XRF spectroscopy, are significantly reduced or eliminated. Therefore, the composition of samples subjected to XRF spectroscopy may be determined with greater precision that what was before possible. Moreover, the shape and design of the target cap allows for relatively greater heat dissipation from the anode substrate than what is possible using a graphite sleeve. Additionally, use of the present target cap avoids the problems associated with outgassing and particle creation encountered with prior art solutions.

These and other features of the present invention will become more fully apparent from the following description and appended claims.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale.

Figure 1:
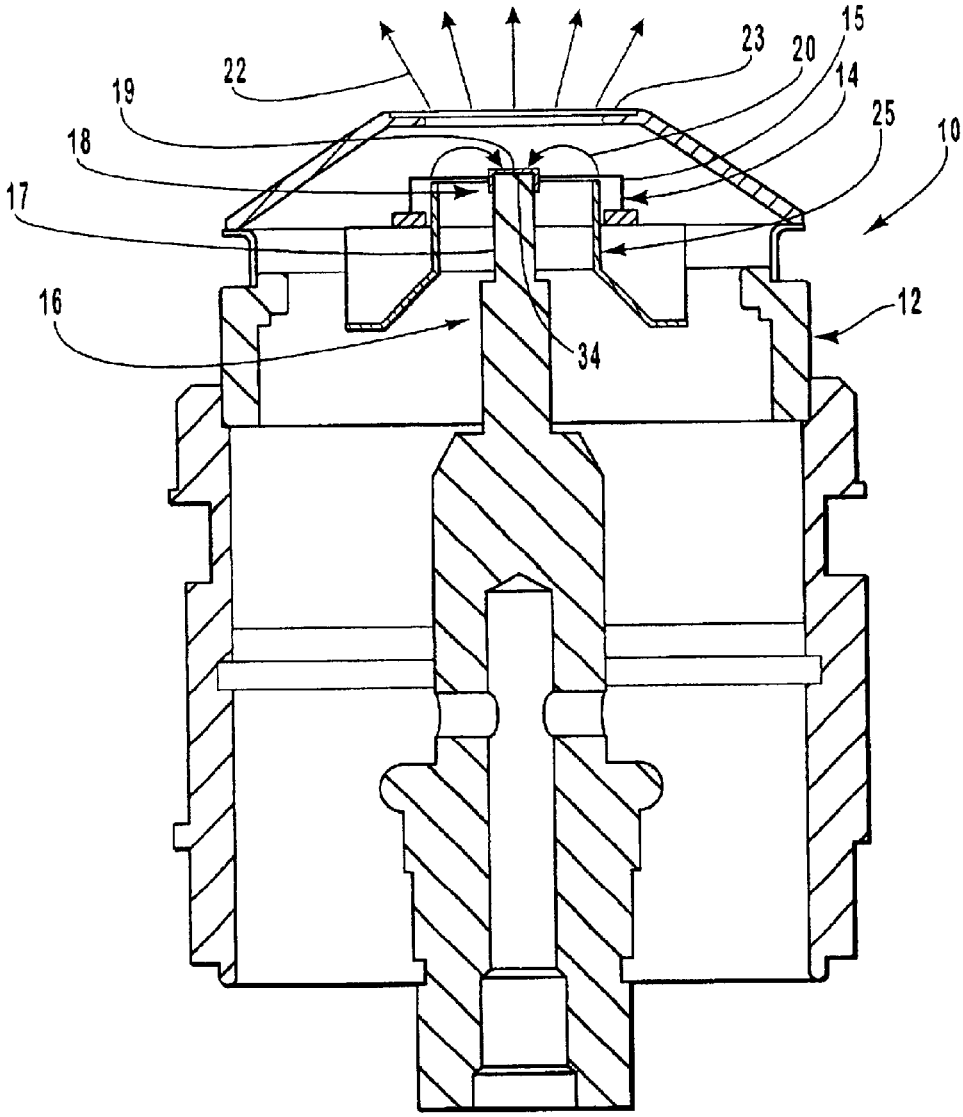
FIG. 1 is a simplified cross sectional side view of a stationary anode x-ray tube configured with a target cap according to one embodiment of the present invention.

Reference is first made to FIG. 1, which depicts one example of an analytical x-ray tube 10 having a stationary anode, such as might be used in XRF spectroscopy applications. It will be appreciated that while the following discussion is directed towards a particular x-ray tube environment, it should not be viewed as limiting of the present invention. Indeed, it will be apparent that embodiments of the invention may find applicability in a number of x-ray tube types and environments. In the illustrated embodiment, the x-ray tube 10 includes an outer housing, generally designated at 12, that forms a vacuum enclosure. Disposed within the vacuum enclosure are a cathode structure 14, and a stationary anode structure 16. The anode structure 16 includes an anode substrate 17. The anode substrate 17 is formed of a material having a high thermal conductivity, such as copper or a copper alloy. The high thermal conductivity of the substrate 17 facilitates dissipation of at least some of the heat produced in the region of the anode structure 16. In preferred embodiments, a target cap 18 is mounted at one end of the substrate 17. A target surface 19 is disposed on a top surface of the target cap 18. Further details concerning the target cap 18 are given below.

In operation, an electrical current is supplied to a filament portion 15 of the cathode structure 14. This causes electrons (depicted at 20) to be emitted from the cathode structure 14 by way of thermionic emission. When high voltage potential is applied between the cathode structure 14 and the anode 16, the electrons 20 accelerate towards the target surface 19 of the target cap 18 portion of the anode. Since they are traveling at high speeds (depending on the magnitude of the voltage potential), the electrons 20 possess a large amount of kinetic energy, and when they impinge upon the target surface 19, a portion of this kinetic energy is converted to x-rays. These primary x-rays, depicted at schematic lines 22, include a relatively large number of characteristic x-rays. Characteristic x-rays are known by this name because they have a wavelength that is characteristic of the material comprising the target surface 19, and are desirably used in analysis procedures such as x-ray fluorescence ("XRF"). For instance, a target surface comprising molybdenum, when impinged by sufficiently energetic electrons, produces two sets of characteristic x-rays, each set having a distinct wavelength from the other set. The x-rays produced by the electrons striking the target surface 19 are directed through a window 23 defined in the housing 12 and toward the specimen being analyzed (not shown).

As mentioned above, only a small percentage of the electrons striking the anode target surface 19 actually stimulate the production of x-rays 22. Much of the kinetic energy is merely released as heat in the region of the target surface. Also, a large portion of the electrons rebound off of the target surface while retaining a large portion of their original kinetic energy. These back-scattered electrons may strike other areas of the x-ray tube, such as the anode substrate 17. These secondary collisions may result in the production of secondary x-rays having characteristic wavelengths that differ from those of the primary stream of x-rays 22. As such, these secondary x-rays can contaminate the primary x-rays, and negatively affect any results.

Figure 2:
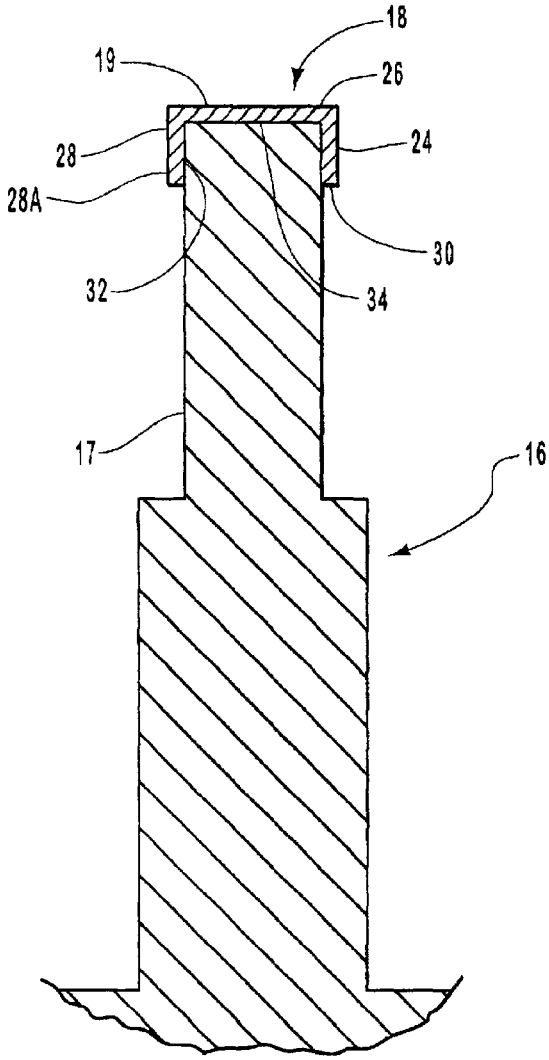
FIG. 2 is a cross sectional side view of the stationary anode as shown in FIG. 1, showing various features of one embodiment of the present target cap.
Figure 3:
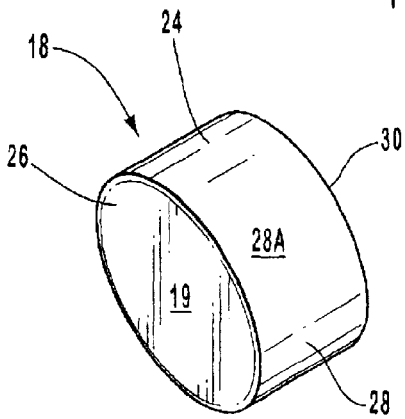
FIG. 3 is a top perspective view of one embodiment of the present target cap.
Figure 4:
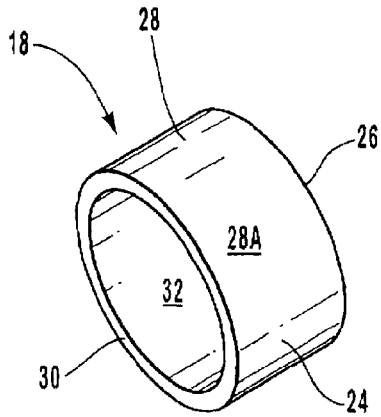
FIG. 4 is a bottom perspective view of the target cap of FIG. 3.

Reference is now made to FIGS. 2, 3, and 4, which show various views of embodiments of an anode target cap. Preferably, the target cap is shaped and configured to prevent the production of contaminating secondary x-rays that can be produced when backscattered electrons impinge upon the substrate 17 of the stationary anode structure 16. As described above, such contaminating secondary electrons may compromise the quality of results obtained by a stationary anode x-ray tube not utilizing the target cap 18 of the present invention.

As is shown in FIGS. 2, 3, and 4, in presently preferred embodiments the target cap, designated generally at 18, generally comprises a body 24 composed of a material capable of producing x-rays when impinged by electrons. Such material may include rhodium, palladium, tungsten, molybdenum, titanium, or other suitable high "Z" number element. It will be appreciated, however, that various other materials, or alloys of these materials, could be used to form the body 24 as required to achieve one or more of the desired objectives described above.

In preferred embodiments, the body 24 of the target cap 18 comprises a top wall 26, which in turn defines the target surface 19. When viewed from above, the outer periphery of the top wall 26 is circular, though it will be appreciated that it may comprise a variety of shapes. The top wall 26 is preferably planar such that the electrons 20 impinged upon it during tube operation produce x-rays 22 that radiate away from the target surface 19 in a predictable pattern. Alternatively, the top wall can have other geometric shapes, again, to achieve a desired radiation pattern.

The body 24 of the target cap 18 further defines in preferred embodiments a cylindrical side wall 28 having a continuous side wall surface 28A, and a bottom 30. Defined on the bottom 30 is a cavity 32 extending a predetermined distance into the interior of the body 24. The cavity 32 of the target cap 18 is preferably shaped to receive a first end 34 of the anode substrate 17 as best seen in FIG. 2, thereby joining the target cap 18 to the anode substrate. In the illustrated embodiment, the fit between the cavity 32 and the first end 34 is tight such that no spacing exists therebetween. In alternative embodiments, a space may be provided, for example to achieve a different thermal conduction characteristic. The target cap 18 is attached to the anode substrate 17 via brazing, welding, casting, or any other suitable method.

Note that, in the illustrated embodiment, the cavity 32 is cylindrical in order to cooperatively fit over the first end 34 of the anode substrate 17, which is also cylindrically shaped. The shape of the cavity 32, however, may be varied as needed to correspond to the shape of the first end 34 of the anode substrate 17.

The longitudinal length of the side wall 28, and thus the depth of the cavity 32, is sufficient to cover that portion of the anode substrate 17 that is susceptible to impingement by backscattered electrons during tube operation. This length may vary as described in another embodiment outlined further below.

The target cap 18 is formed using standard manufacturing techniques, such as machining, forging, extruding, and casting. The afore-mentioned components that comprise the target cap 18 may be integrally formed, or may be joined after separate manufacture. Preferably, the target cap 18 is cleaned via diamond grinding and degreasing after its manufacture to reduce the chance for particle contamination within the vacuum enclosure formed by the outer housing 12.

As described above, the target cap 18 reduces or eliminates the incidence of contaminating secondary x-rays created by backscattered electrons that would otherwise impinge upon the anode substrate 17. During tube operation, a portion of the electrons 20 incident upon the target surface 19 produce a quantity of primary x-rays 22 emitted as a stream from the window 23. Many more of the electrons 20, however, do not produce x-rays, but rather rebound from the target surface, thus becoming backscattered electrons. Given the positive voltage potential of the stationary anode structure 16, a significant portion of these backscattered electrons are re-attracted to the anode structure and are directed either toward the target surface 19 again or toward an adjacent portion of the structure. The side wall 28 of the target cap 18 covers the portion of the stationary anode structure 16 adjacent the target surface 19 that is susceptible to impingement by the backscattered electrons. Instead of impacting a portion of the anode substrate 17, then, the backscattered electrons impinge upon the side wall surface 28A of the target cap 18. This impingement may produce secondary x-rays. As an integral part of the target cap 18, the side wall 28 is composed of the same x-ray producing material that comprises the target surface 19 defined on the top wall 26. Thus, the wavelength spectrum of the secondary x-rays produced by these backscattered electrons impacting the side wall surface 28A of the target cap 18 closely resembles the spectrum of the stream of primary x-rays 22 produced by the target surface 19 of the target cap. Specifically, the wavelengths of the secondary characteristic x-rays produced by the backscattered electron impacts with the side wall surface 28A are substantially identical to the wavelengths of the primary characteristic x-rays produced by the target surface 19. As mentioned above, many of these secondary characteristic x-rays will escape through the window 23 together with the characteristic x-rays found in the stream of primary x-rays 22. Because their characteristic wavelengths are substantially identical, however, these secondary x-rays will not contaminate the primary x-ray stream, but will rather blend with it. Thus, a major source of contamination to the stream of primary x-rays 22 is significantly reduced or eliminated. Optimally, additional shielding, such as that shown at 25 in FIG. 1, could also be used.

A further benefit is achieved with the present invention in view of the fact that the outer surfaces defined by the target cap 18 provide a continuous heat path from which heat generated at the target surface may be more efficiently conducted and dissipated.

Some electrons, whether direct or backscattered, may penetrate a certain distance into the target cap 18 before producing x-rays. Because of this, the thicknesses of both the top wall 26 and the side wall 28 must be sufficient to prevent the complete penetration of electrons through the target cap 18 and into the substrate 17 where contaminating x-rays may be produced. The distance that an electron will penetrate into the target cap 18 is dependent both upon the energy of the electron and the type of material comprising the target cap 18. That is, higher energy x-ray tubes produce electrons that have relatively higher kinetic energies, and thus more penetrating power, than those produced by lower energy tubes. Also, a target cap 18 comprised of a lower Z number element allows electrons to penetrate relatively deeper into the cap than one comprised of a higher Z number element. If the thickness of either the top 26 or the side wall 28 of the target cap 18 is too thin for a given x-ray tube energy and target cap material, contaminating x-rays from the anode substrate 17 may be produced. To avoid this, a preferred embodiment of the target cap 18 comprises a top wall 26 and a side wall 28 having thicknesses in a range of from approximately 0.01 inch to about 0.1 inch. Of course, the thickness of the above walls may be varied to suit the needs of a particular application, with special attention being paid to the type of material comprising the target cap 18 and the power characteristics of the x-ray tube 10. Also, the thickness of the top 26 may be different than that of the side wall 28, if desired.

The longitudinal length of the side wall 28 is determined according to the particular application in which the x-ray tube 10 is employed and, more especially, the power of the x-ray tube. For example, and as mentioned above, higher energy x-ray tubes are able to produce backscattered electrons that have relatively higher kinetic energies than those produced by lower energy x-ray tubes. Backscattered electrons having relatively high kinetic energies are able to travel a greater distance from the target surface 19, and thus may be able to impact on a portion of the stationary anode structure 16 that is relatively far away from the target surface. Thus, in a preferred embodiment, the longitudinal length of the side wall 28 is sufficiently long to cover those portions of the anode substrate 17 that would otherwise be impinged by the backscattered electrons. In one embodiment, the longitudinal length of the side wall 28 is in a range of from about 0.05 inch to about 0.5 inch.

Figure 5:
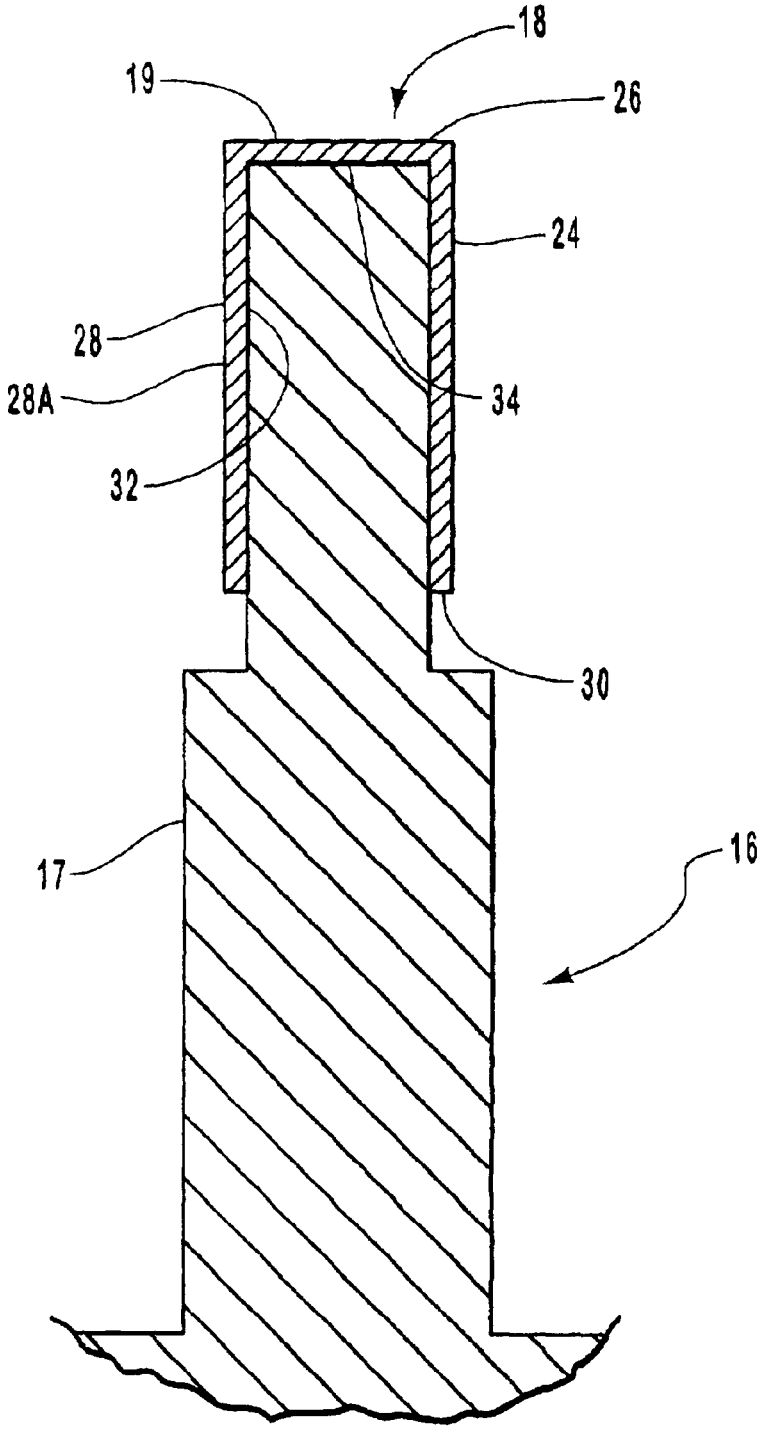
FIG. 5 is a cross sectional side view of another embodiment of the present target cap.

FIG. 5 shows another embodiment of the present target cap 18. As can be seen from the figure, the longitudinal length of the side wall 28 may be varied to cover a predetermined portion of the anode substrate 17, as may be required for a particular application, in order to prevent the impingement of backscattered electrons on the substrate. In like manner, the length, thickness, and other dimensions of the components of the target cap 18 may be varied according to the intended use and operating characteristics of the x-ray tube in which the cap is disposed.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube, comprising:

a vacuum enclosure in which are disposed an electron producing cathode and a stationary anode, the stationary anode being positioned to receive at least some of the electrons emitted by the cathode so that x-rays are produced and emitted through a window in the vacuum enclosure, wherein the stationary anode comprises:

a substrate having first and second ends; and a target cap having top and side walls that together define a cavity that at least partially receives the first end of the anode substrate and in a manner such that the side walls extend in a direction towards the second end of the anode substrate, and wherein the target cap defines a target surface comprised of an x-ray producing material at a point such that at least some of the electrons emitted by the cathode impinge the target surface to produce primary x-rays having one or more characteristic wavelengths.

2. An x-ray tube as defined in claim 1, wherein at least a portion of the target cap comprises a material selected from the group consisting of rhodium, palladium, molybdenum, titanium, and tungsten or alloys thereof.

3. An x-ray tube as defined in claim 1, wherein the cavity is cylindrically shaped.

4. An x-ray tube as defined in claim 1, wherein the cavity receives the first end of the substrate so as to form a substantially contiguous fit therebetween.

5. An x-ray tube as defined in claim 1, wherein the side wall is comprised of a material such that x-rays emitted therefrom have secondary wavelengths that do not interfere with the primary x-rays produced by the target surface.

6. An x-ray tube as defined in claim 5, wherein the secondary x-rays have characteristic wavelengths that are substantially identical to the characteristic wavelengths of the primary x-rays produced at the target surface.

7. An x-ray tube as defined in claim 1, wherein the target surface has a substantially planar shape.

8. The x-ray device as recited in claim 1, wherein the cathode comprises a filament.

9. The x-ray device as recited in claim 1, wherein the anode structure is substantially metallic.

10. The x-ray device as recited in claim 1, further comprising shielding disposed about a portion of the anode substrate.

11. A target cap configured for attachment to a stationary anode substrate, the stationary anode substrate being disposed within a vacuum enclosure in an x-ray tube, wherein the target cap comprises:

a planar top wall defining a target surface and a continuous side wall, wherein the walls cooperate to define a cavity into which a portion of the stationary anode substrate is received, and wherein the top wall is comprised of a material that produces primary x-rays when impinged by electrons, at least some of the primary x-rays having one or more characteristic wavelengths, and wherein the side wall is comprised of a material such that the side wall produces secondary x-rays when impinged by electrons, the secondary x-rays having wavelengths that do not interfere with the primary x-rays.

12. A target cap as defined in claim 11, wherein at least some of the secondary x-rays produced by the side wall have one or more characteristic wavelengths that are substantially identical to the one or more characteristic wavelengths of at least some of the primary x-rays.

13. A target cap as defined in claim 11, wherein the target cap comprises a material selected from the group consisting of rhodium, palladium, molybdenum, titanium, and tungsten and alloys thereof.

14. A target cap as defined in claim 11, wherein the cavity is cylindrically shaped.

15. A stationary anode comprising:

a substantially metallic anode substrate having first and second ends; and a target cap having top and side walls that together define a cavity that at least partially receives the first end of the anode substrate and in a manner such that the side walls extend in a direction towards the second end of the anode substrate, and wherein the target cap defines a target surface comprised of an x-ray producing material at a point such that at least some of the electrons emitted by the cathode impinge the target surface to produce primary x-rays having one or more characteristic wavelengths.

16. A stationary anode as defined in claim 15, wherein at least a portion of the target cap comprises a material selected from the group consisting of: rhodium; palladium; molybdenum; titanium; and, tungsten or alloys thereof.

17. A stationary anode as defined in claim 15, wherein the cavity is substantially cylindrically shaped.

18. A stationary anode as defined in claim 15, wherein the cavity receives the first end of the substrate so as to form a substantially contiguous fit therebetween.

19. A stationary anode as defined in claim 15, wherein the side wall is comprised of a material such that x-rays emitted therefrom have secondary wavelengths that do not interfere with the primary x-rays produced by the target surface.

20. A stationary anode as defined in claim 19, wherein at least some of the secondary wavelengths of the x-rays emitted from the sidewall are substantially identical to the characteristic wavelengths of the primary x-rays produced at the target surface.

21. A stationary anode as defined in claim 15, wherein the target surface has a substantially planar shape.

* * * * *